US007048651B2

(12) United States Patent
Kennedy, III et al.

(10) Patent No.: US 7,048,651 B2
(45) Date of Patent: May 23, 2006

(54) GOLF BALL

(75) Inventors: Thomas J. Kennedy, III, Wilbraham, MA (US); Robert Phelps, Granby, MA (US); Stephen M. Green, Syracuse, NY (US)

(73) Assignee: Callaway Golf Company, Carlsbad, CA (US)

( * ) Notice: Subject to any disclaimer, the term of this patent is extended or adjusted under 35 U.S.C. 154(b) by 131 days.

(21) Appl. No.: 10/666,437

(22) Filed: Sep. 22, 2003

(65) Prior Publication Data

US 2004/0142765 A1 Jul. 22, 2004

Related U.S. Application Data

(63) Continuation-in-part of application No. 09/413,608, filed on Oct. 6, 1999, now abandoned, which is a continuation-in-part of application No. 09/166,970, filed on Oct. 6, 1998, now abandoned.

(51) Int. Cl.
*A63B 37/12* (2006.01)

(52) U.S. Cl. ..... 473/378

(58) Field of Classification Search ..... 473/351, 473/378

See application file for complete search history.

(56) References Cited

U.S. PATENT DOCUMENTS

| | | | |
|---|---|---|---|
| 1,814,170 | A | 7/1931 | Long |
| 1,814,312 | A | 7/1931 | Heane |
| 1,921,571 | A | 8/1933 | Jones |
| 2,539,303 | A | 1/1951 | Gerke |
| 3,268,634 | A | 8/1966 | Glaser |
| 3,781,214 | A | 12/1973 | Nemoto et al. |
| 3,803,109 | A | 4/1974 | Nemoto et al. |
| 3,804,735 | A | 4/1974 | Radlowe et al. |
| 3,847,770 | A | 11/1974 | Radlowe et al. |
| 3,856,744 | A | 12/1974 | Radlowe et al. |
| 4,086,851 | A | 5/1978 | Brandell |
| 4,128,536 | A | 12/1978 | Brodsky et al. |
| 4,164,423 | A | 8/1979 | Schumacher et al. |
| 4,178,186 | A | 12/1979 | Yasui et al. |
| 4,200,667 | A | 4/1980 | Lee et al. |
| 4,251,341 | A | 2/1981 | Felder et al. |
| 4,264,483 | A | 4/1981 | Laufer et al. |

(Continued)

FOREIGN PATENT DOCUMENTS

| | | | |
|---|---|---|---|
| DE | 3532327 | A | 3/1987 |

(Continued)

OTHER PUBLICATIONS

English Abstract for JP 6262842, published Sep. 20, 1994.

(Continued)

*Primary Examiner*—Raeann Gorden
(74) *Attorney, Agent, or Firm*—Michael A. Catania; Elaine H. Lo

(57) ABSTRACT

A golf ball having an indicia produced by ink jet printing is disclosed. An ink composition containing a coloring agent and a resin is dispensed on a transfer medium, using an ink jet printer, to form an indicia. The indicia is transferred from the transfer medium to the dimpled surface of a golf ball. In another form of the invention, an indicia is applied directly to a golf ball, without a transfer medium. In this method, an indicia receiving layer is applied on at least a portion of the golf ball surface, then the indicia is printed directly on the indicia receiving layer using an ink jet printer. The indicia on the golf ball has an impact resistance suitable for use in competitive play.

18 Claims, 9 Drawing Sheets

U.S. PATENT DOCUMENTS

| | | | | |
|---|---|---|---|---|
| 4,271,258 | A | | 6/1981 | Watariguchi |
| 4,280,767 | A | | 7/1981 | Heath |
| 4,303,697 | A | | 12/1981 | Baseden |
| 4,374,670 | A | | 2/1983 | Slocombe |
| 4,419,196 | A | | 12/1983 | Beckerick et al. |
| 4,508,570 | A | | 4/1985 | Fujii et al. |
| 4,511,268 | A | | 4/1985 | Marshall |
| 4,546,644 | A | | 10/1985 | Beny et al. |
| 4,606,664 | A | | 8/1986 | Pascoe |
| 4,613,403 | A | | 9/1986 | Oyachi et al. |
| 4,679,794 | A | | 7/1987 | Yamada et al. |
| 4,680,368 | A | | 7/1987 | Nakamoto et al. |
| 4,776,270 | A | | 10/1988 | Kumamoto |
| 4,836,102 | A | | 6/1989 | Cicci |
| 4,856,670 | A | | 8/1989 | Hang et al. |
| 4,864,324 | A | | 9/1989 | Shirota et al. |
| 4,865,326 | A | | 9/1989 | Isaac et al. |
| 4,875,410 | A | | 10/1989 | Lec et al. |
| 4,911,451 | A | | 3/1990 | Sullivan et al. |
| 5,085,697 | A | | 2/1992 | Kimura et al. |
| 5,088,737 | A | | 2/1992 | Frank et al. |
| 5,156,405 | A | | 10/1992 | Kitaoh et al. |
| 5,160,536 | A | | 11/1992 | Harris et al. |
| 5,166,186 | A | | 11/1992 | Kojime et al. |
| 5,169,386 | A | | 12/1992 | Becker et al. |
| 5,200,122 | A | | 4/1993 | Katoh et al. |
| 5,248,878 | A | | 9/1993 | Ihara |
| 5,266,362 | A | | 11/1993 | Katoh et al. |
| 5,275,646 | A | | 1/1994 | Marshall et al. |
| 5,391,685 | A | | 2/1995 | Hitomi et al. |
| 5,427,377 | A | | 6/1995 | Maruoka |
| 5,429,860 | A | | 7/1995 | Held et al. |
| 5,445,912 | A | | 8/1995 | Hauquier et al. |
| 5,450,791 | A | | 9/1995 | Prohm |
| 5,456,954 | A | | 10/1995 | Sullivan |
| 5,468,712 | A | | 11/1995 | Minato et al. |
| 5,488,907 | A | | 2/1996 | Xu et al. |
| 5,531,819 | A | | 7/1996 | Sawada |
| 5,542,680 | A | | 8/1996 | Proudfit et al. |
| 5,580,323 | A | | 12/1996 | Sullivan |
| 5,592,204 | A | | 1/1997 | Lin et al. |
| 5,616,418 | A | | 4/1997 | Vasselin et al. |
| 5,621,022 | A | | 4/1997 | Jaeger et al. |
| 5,627,578 | A | | 5/1997 | Weintraub |
| 5,634,399 | A | | 6/1997 | Pepin et al. |
| 5,652,609 | A | | 7/1997 | Scholler et al. |
| 5,678,290 | A | | 10/1997 | Good |
| 5,679,198 | A | | 10/1997 | Olsen et al. |
| 5,684,515 | A | | 11/1997 | Ho |
| 5,690,721 | A | | 11/1997 | Itoh |
| 5,697,715 | A | | 12/1997 | Kuroda et al. |
| 5,770,325 | A | * | 6/1998 | Keller et al. ..... 428/187 |
| 5,778,793 | A | * | 7/1998 | Mello et al. ..... 101/494 |
| 5,785,612 | A | | 7/1998 | Shapiro et al. |
| 5,817,735 | A | * | 10/1998 | Hatch et al. ..... 528/84 |
| 5,820,491 | A | * | 10/1998 | Hatch et al. ..... 473/378 |
| 5,831,641 | A | | 11/1998 | Carlson |
| 5,889,084 | A | | 3/1999 | Roth |
| 5,931,166 | A | | 8/1999 | Weber et al. |
| 6,057,043 | A | | 5/2000 | Kametani et al. |
| 6,135,654 | A | | 10/2000 | Jennel |
| 6,179,732 | B1 | | 1/2001 | Inoue et al. |
| 6,245,386 | B1 | | 6/2001 | Felker et al. |
| 6,551,395 | B1 | * | 4/2003 | Isogawa ..... 106/31.75 |
| 6,736,055 | B1 | | 5/2004 | Lutz et al. |
| 2002/0097280 | A1 | * | 7/2002 | Loper et al. ..... 347/2 |
| 2003/0121427 | A1 | * | 7/2003 | Lampinski et al. ..... 101/35 |

FOREIGN PATENT DOCUMENTS

| | | | |
|---|---|---|---|
| EP | 471079 | | 2/1992 |
| EP | 0 802 051 | | 10/1997 |
| GB | 2022116 | A | 5/1979 |
| GB | 2227671 | A | 8/1990 |
| GB | 2211791 | A | 12/1992 |
| GB | 2256874 | A | 12/1992 |
| GB | 2330838 | | 5/1999 |
| JP | 57-159824 | | 10/1982 |
| JP | 58-098340 | | 6/1983 |
| JP | 59-14702 | | 1/1984 |
| JP | 60-141584 | | 7/1985 |
| JP | 02-128774 | | 5/1990 |
| JP | 2128774 | A | 5/1990 |
| JP | 4061870 | | 2/1992 |
| JP | 61-86263 | | 7/1994 |
| JP | 63-21250 | | 11/1994 |
| JP | 8308958 | A | 11/1996 |
| JP | 08-322967 | | 12/1996 |
| JP | 8322967 | A | 12/1996 |
| JP | 9028836 | | 2/1997 |
| JP | 10147097 | | 6/1998 |
| WO | 91/11484 | | 8/1991 |
| WO | WO 98/37982 | | 9/1998 |
| WO | WO 98/38241 | | 9/1998 |

OTHER PUBLICATIONS

English Abstract for DE 4312553, published Oct. 20, 1994.
English Abstract for JP 5096028, published Apr. 20, 1993.
English Abstract for JP 4296588, published Oct. 20, 1992.
English Abstract for JP 4122675, published Apr. 23, 1992.
English Abstract for JP 88044558, published Sep. 6, 1988.
English Abstract for JP 63089377, publ. Apr. 20, 1988 & JP 94084098, publ. Jul. 10, 1994.
English Abstract for JP 62034582, publ. Feb. 14, 1987.
English Abstract for JP 58183285, publ. Oct. 26, 1983 & JP 89032792, publ. Jul. 10, 1989.
L-526-163-B, Qure Tech Material Safety Data Sheet (Jan. 12, 1995).
L-526-163-C,Qure Teach Material Safety Data Sheet (Jan. 12, 1995).
Trans Tech America, Inc. UV Curable Pad Printing Ink, Material Safety Data Sheet, (Nov. 3, 1993).
Dando, N.R. et al, "Performance Optimization of 100% Solids, UV-Cure Inks and Wood Fillers Using Aluminum Trihydroxide (ATH) Filler", *Journal of Coatings Technology*, vol. 68, No. 859, Aug. 1996.
UK Search Report for GB 9613959.7.
Hilton, Don Ink jet printing: new energy drives a proven technology, (includes related article on how ink jet printing works)(Printers), Modern Office Technology, V38, n3, p. 38(2), Mar., 1993.
Jaime 100C, small character ink jet printer, The United Sales Company (2pp).
Johnson, Jerome, L "Principles of Nonimpact Printing" Second Edition (pp. 302-337), Plantation Press.
Digital Multicolour Decorating Tampo Print (5pp).
Himowitz, Michael J. "Printing Better Digital Photos", Fortune (2pp) Sep. 8, 1997.
O'Leary, Sean "Of Truck Sides and Superwides", (4 pgs total inc 1 p. 70, 71, 74) Screen Printing.
Goldwasser, Sam "Printer and Copier Basics", Electronics Now, v69, n2, p. 63(3) Feb., 1998.
Shears, Jay Epson Micro Piezo, (Peripherals)(Technical excellence awards)(includes related article on the other finalists in this category)(Technology Information)(cover Story), PC Magazine, v16, n22, p. 103(1), Dec. 16, 1997.
Lucky squirt: ink-jet printers, The Econimist, v332, n7873, p. 80(2), Jul. 23, 1994.

English Abstract for JP Publication No. 113208963 publication date Nov. 24, 1999.
English Abstract for JP 58087096, publ. May 24, 1983.
Stowe, F.S. and LieBaerman, R.A., "Effect of Selected UV Bulbs and Photocatalysts On Multifunctional Acrylate Monomer/Homopolymer Properties" (1985).
McDermott, M., "The Effects of Oligomer Type and Monomer Alkoxylation on Dynamic Surface Tension".
Sinka, J.V. and LieBerman, R.A., "New Developments in Second Generation Radiation Curable Products for Printed Circuit Boards and Fiber Optics" *Radiation Curing*, (Nov. 1983).
Stowe, F.S., "Specialty Reactive Monomers For RC Coatings", (first 8 pp.), reprinted from *Modern Paint and Coatings*, (Aug. 1982).
Sinka, JU.V. and Mazzoni, D., "Specialty Glycidyl Ethers for Cationic Ultraviolet Cure Systems", pp. 378-388.
Stowe, F.S. and Lieberman, R.A., "Methoxy Ether Acrylates—Novel Ratiation Curing Monomers", pp. 14-71—14-92.
Sinvacure UVRP (UVRP) Inks:, Summit Screen Inks Fact Sheet.
L-526-163-A, Qure Tech Material Safety Data Sheet (Jan. 12, 1995).

* cited by examiner

CUSTOM STAMP

SOLVENT BASED INKJET

GOLF BALL

This application is a continuation-in-part of application Ser. No. 09/413,608, filed Oct. 6, 1999 now abandoned, which is a continuation-in-part of application Ser. No. 09/166,970, filed Oct. 6, 1998 now abandoned.

FIELD OF THE INVENTION

The present invention generally relates to golf balls having indicia, such as indicia produced by the ink jet printing on curved surfaces. More particularly, the present invention is directed to ink jet printing on golf balls having dimpled surfaces.

BACKGROUND OF THE INVENTION

Inks that are used in ink jet printing commonly are water-based resins which contain dye as a coloring agent. Other types of inks, such as solvent-based (i.e., non-aqueous) formulations and ultraviolet ("UV") curable inks, could be useful in ink jet printing if an appropriate viscosity and surface tension of the ink could be achieved as to be compatible with both the ink jet printing system and the golf ball surface.

UV curable inks are quick-curing inks and therefore are advantageous for use in continuous-type processes in which subsequent treatment of an ink-printed substrate is involved. A number of UV curable inks are known. For example, U.S. Pat. No. 4,271,258 discloses a photopolymerizable ink composition containing acrylate resin, methacrylate monomer or oligomer, acrylate monomer or oligomer, photoinitator, and a particular type of an epoxy resin. U.S. Pat. No. 5,391,685 discloses a UV curable ink having an isocyanate compound added thereto. U.S. Pat. No. 5,391,685 contends that the ink disclosed therein is particularly well suited for printing on slightly adhesive plastic bases, such as those made of polyoxymethylenes and polypropylenes.

Screen printing on spherical surfaces such as golf balls can be difficult. As a result, pad printing customarily is used for marking golf ball surfaces. However, many of the known UV curable inks are not well suited for pad printing due to difficulties in transferring the ink from a pad to a substrate. Furthermore, UV curable inks that can be pad printed have not been found suitable for use on golf balls. More specifically, when applied to a golf ball, these inks are not sufficiently durable (impact resistant) to withstand multiple blows by a golf club. It would be useful to obtain a highly durable UV curable ink which has favorable pad transfer properties when used for printing an indicia on a surface such as a curved and dimpled surface of a golf ball, and which provides an image having good durability.

Ink jet printing is commonly used to form multicolor images on paper for use in advertising materials, computer-generated photographs, etc. There are two fundamental types of ink jet printing: continuous and drop on demand. U.S. Pat. No. 5,623,001 describes the distinction between continuous and drop on demand ink jet printing. In continuous ink jet printing, a stream of ink drops is electrically charged and then deflected by an electrical field either directly or indirectly onto the substrate. In drop on demand ink jet printing, the ink supply is regulated by an actuator such as a piezoelectric actuator. The pressure produced by the actuation forces a droplet through a nozzle or nozzles onto the substrate.

It is known to print directly on a game ball surface using a continuous ink jet printer which relies on an electric charge to deliver droplets of ink to the game ball surface. (See JP 8322967-A published Dec. 10, 1996 (Bridgestone) and JP 2128774-A published May 17, 1990 (Bridgestone)).

SUMMARY OF THE INVENTION

An object of the invention is to provide a new and improved method of forming durable images on golf balls, and the resulting golf balls produced thereby.

Another object of the invention is to provide a method of forming multi-color images on golf balls. This object also includes the balls produced by this process.

A further object of the invention is to provide a method of quickly and efficiently transferring a logo or image from a computer screen to a golf ball surface and the resulting product produced thereby.

Another object of the invention is to provide a golf ball, having a clear and durable ink image printed thereon.

Another object of the invention is to provide a method for printing an indicia on a hard surface of a golf ball, the indicia comprising ink jet printable ink.

Yet another object of the invention is to provide a method for applying smudge resistant and durable indicia to a visible surface of a golf ball.

Other objects of the invention will be in part obvious and in part pointed out more in detail hereafter. The present invention satisfies at least one of the foregoing objects, at least in part.

One aspect of the invention is a method of applying at least one indicia to a golf ball, comprising: obtaining an ink composition suitable for use in ink jet printing, dispensing the ink composition in the form of an indicia on a transfer medium using an ink jet printer, and transferring the indicia from the transfer medium to the surface of a golf ball.

The transfer medium comprises at least one member selected from the group consisting of silicone, fluoropolymer, and polypropylene. The transfer medium can be a low surface energy material.

In one form of the invention, the ink composition contains a polymer resin. In another form of the invention, the ink composition contains resin components.

An alternative method further includes: forming a protective coating over the indicia on the surface of the golf ball. The protective coating can include a polyurethane.

The method of the invention optionally includes forming a printer coating layer on at least a portion of the surface of golf ball. The primer coating layer can contain a material which promotes at least one of absorption, adhesion and clarity of the indicia. Several examples of this material are talc, amorphous silica, bentonite clay, magnesium silicate, or combinations of these materials.

The transfer medium used in the method of the invention can be a silicone-containing medium such as a sheet or a pad.

In one form of the invention, the ink composition is an aqueous-based formulation. In another form of the invention, the ink composition is a non-aqueous, or solvent-based, formulation. In another alternative form of the invention, the ink comprises a UV curable resin, and the method further comprises: curing the indicia after the indicia has been transferred onto the golf ball surface.

Another aspect of the invention is a method of applying an indicia to a golf ball, comprising: obtaining an ink composition suitable for use in ink jet printing, forming an indicia receiving layer on at least a portion of the golf ball surface, the indicia receiving layer containing a material which promotes absorption, adhesion or clarity of the indicia, and printing an indicia on the indicia receiving layer using an ink jet printer. Optionally, the method further includes: forming a protective coating over the indicia. The indicia may have impact resistance sufficient to render the golf ball suitable for use in competitive play.

The indicia receiving layer optionally comprises a polyurethane.

The material which promotes absorption, adhesion or clarity of the indicia can be talc, amorphous silica, bentonite clay, magnesium silicate, or combinations thereof.

The indicia can be printed directly on the golf ball surface using the ink jet printer. Alternatively, the indicia can be printed on a transfer medium using the ink jet printer, and can be subsequently transferred to the surface of the indicia receiving layer of the golf ball. A drop-on-demand ink jet printer can be used. It can have a piezo crystal or thermal printhead.

In another optional form of the invention, the ink comprises an UV curable resin, and the method further comprises: curing the indicia after the indicia has been printed on the indicia receiving layer.

Another aspect of the invention is a method of applying an indicia to a golf ball, comprising: obtaining a UV curable ink composition suitable for use in ink jet printing, printing an indicia on a surface of the golf ball using an ink jet printer, and curing the UV ink composition. The method can further include: forming a protective coating over the indicia.

Another aspect of the invention is a method of applying an indicia to a golf ball, comprising: obtaining an ink composition suitable for use in ink jet printing, printing an indicia on the surface of a golf ball using a drop-on-demand ink jet printer, and forming a protective coating over the indicia. The resolution of the indicia may be at least about 300 dots per inch ("d.p.i.") (about 120 dots per cm), optionally at least about 500 d.p.i. (about 200 dots per cm), optionally at least about 600 d.p.i. (about 240 dots per cm), optionally at least about 1000 d.p.i. (about 390 dots per cm).

BRIEF DESCRIPTION OF THE DRAWINGS

The following is a brief description of the drawings, which are presented for the purposes of illustrating the present invention and not for the purposes of limiting the same.

DETAILED DESCRIPTION OF THE PREFERRED EMBODIMENTS

One method of the invention for forming an image on a golf ball using ink jet printing is an indirect printing technique which involves printing an indicia on a transfer medium using an ink jet printer and then transferring the image from the transfer medium to the golf ball surface. Another method of the invention is to print directly on a specially treated surface of a golf ball using an ink jet printer.

Figure 1:
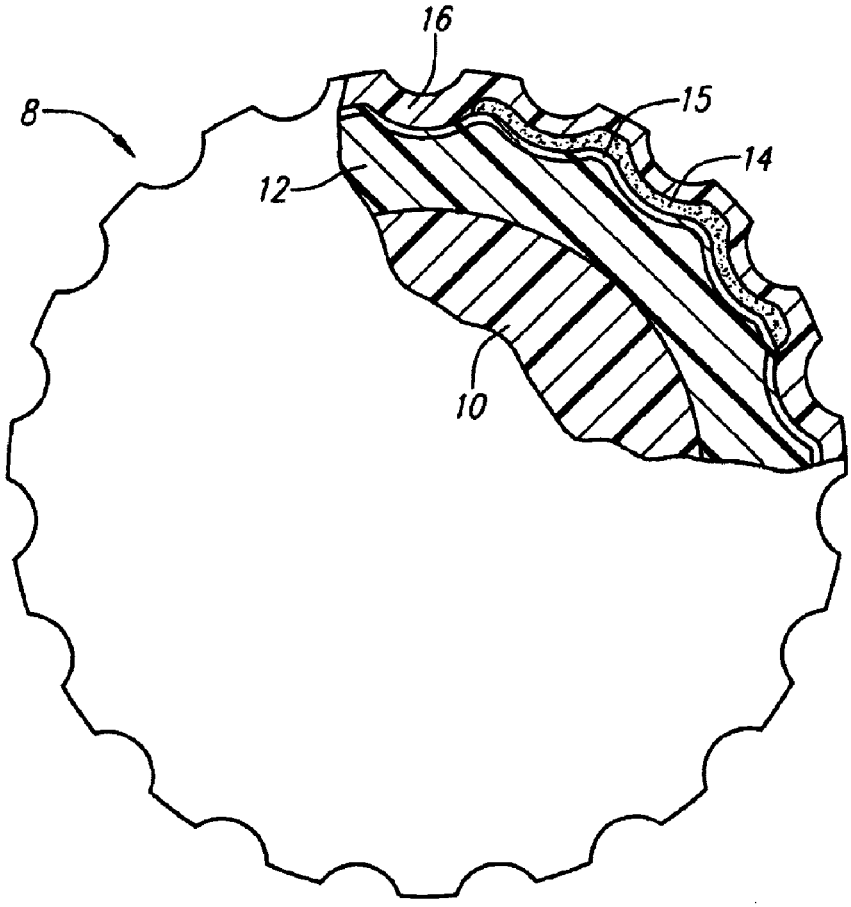
FIG. 1 depicts a golf ball having an indicia comprising ink jet printable ink in accordance with the present invention.

A golf ball formed according to one embodiment of the present invention is shown in FIG. 1. The golf ball 8 has a central core 10, which can be solid, liquid, gas, gel, wound, or a combination of these, and a dimpled cover 12 surrounding the core. An indicia 14 formed from an ink jet printable ink is formed over the cover 12. Optionally, an indicia receiving layer 15 is positioned between the indicia 14 and the cover 12. A protective top coat 16 is formed over the indicia 14. This top coat 16 may cover the entire ball 8, though a partial topcoat 16 covering only a somewhat larger area than the indicia 14 is also contemplated.

Figure 2:
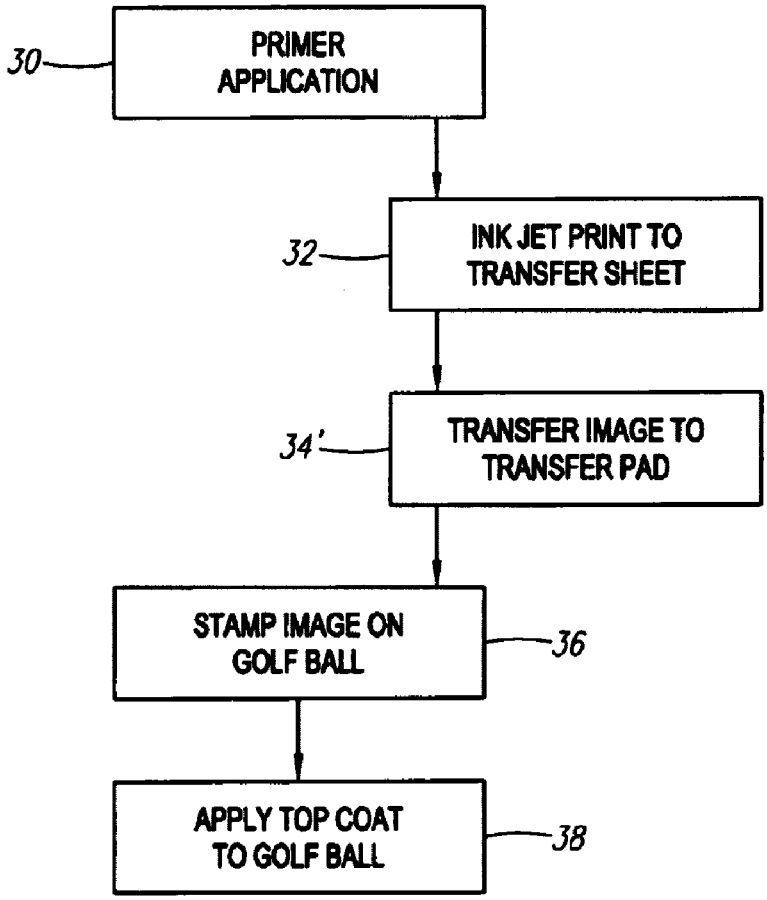
FIG. 2 is a flow chart depicting a method for applying ink jet printable indicia to a golf ball by indirect transfer.
Figure 4:
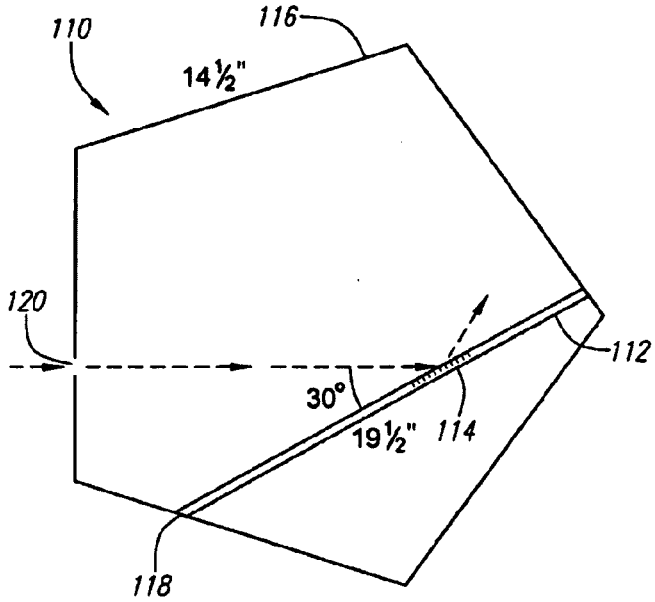
FIG. 4 schematically depicts the durability test apparatus to determine the durability of the indicia of the invention on a golf ball.
Figure 11:
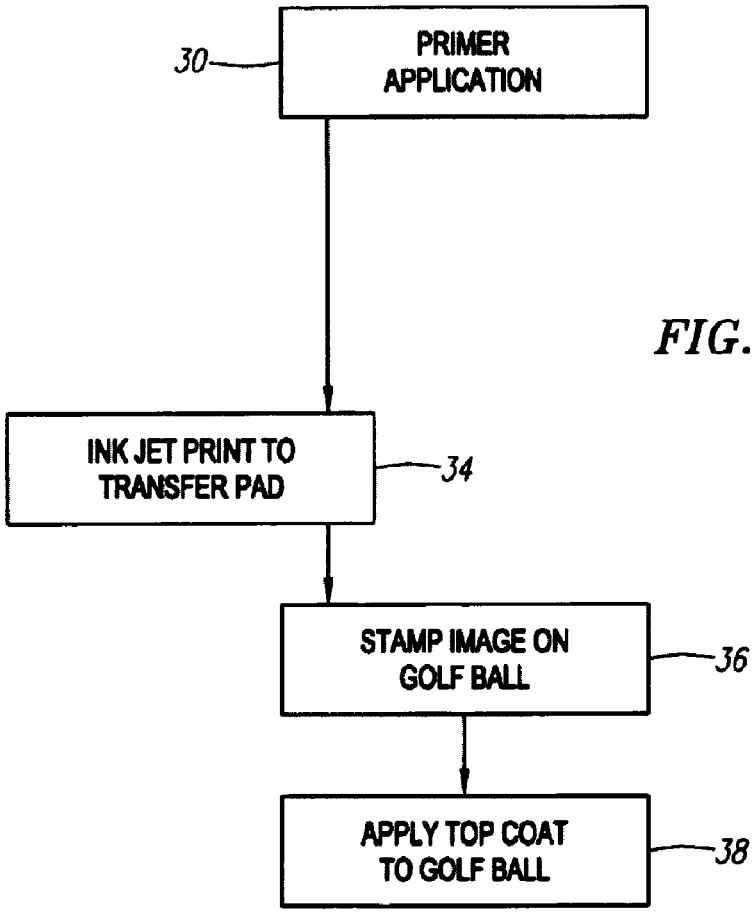
FIG. 11 is a flow chart depicting an alternative method to that of FIG. 2 for applying ink jet printable indicia to a golf ball by indirect transfer.

Two methods of indirectly ink jet printing on a golf ball surface are depicted in FIGS. 2 and 11, respectively. As shown at 30 in each figure, a golf ball is primed with an ink retaining primer. An image is ink jet printed onto a transfer sheet, as shown at 32 (FIG. 2), or transfer pad, as shown at 34 (FIG. 4). If the image is printed onto a transfer sheet (as in FIG. 2), it is then transferred to a transfer pad on a stamping machine at 34'. The transfer pad, which is configured for printing on the surface of a golf ball, subsequently stamps the image on a golf ball surface at 36. After the image is applied, the surface of the ball and the indicia optionally can be coated with a suitable top coat at 38.

Figure 3:
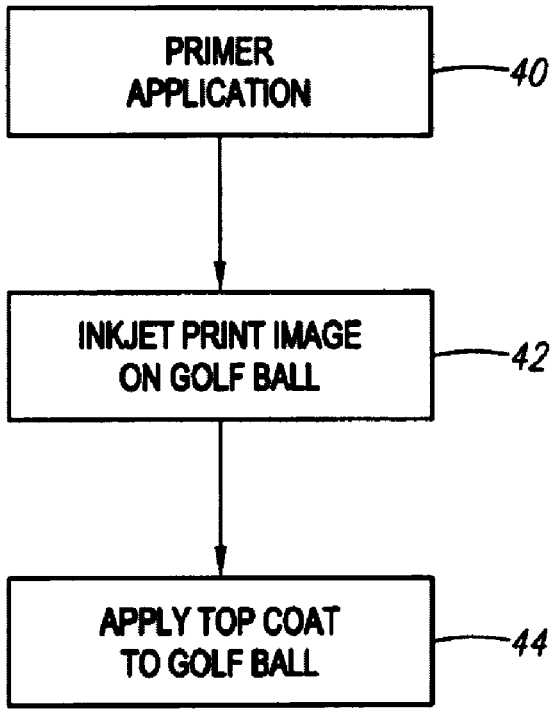
FIG. 3 is a flow chart depicting a method for applying an ink jet printable indicia to a golf ball using a direct printing method.

A method for directly ink jet printing on a golf ball is shown in FIG. 3. As shown at 40, a golf ball is primed with an ink retaining primer. After the coating has been applied, an image is ink jet printed directly onto the surface of the primer at 42. After the image has been applied, the surface of the ball and the indicia optionally can be coated with a suitable top coat at 44.

The method of the invention can be used on curved surfaces of game balls such as golf balls, basketballs, baseballs, softballs, and the like, and is particularly useful on golf balls. It can be difficult to print on the curved and dimpled surface of a golf ball because the dimples tend to distort an image printed thereon and because the plastic cover of a golf ball, which typically is made of ionomer, balata, or polyurethane, has a low surface energy. The low surface energy of the ionomer cover makes adhesion difficult and also causes ink to form into beads when placed on the cover, thereby blurring the printed image. One way in which the present invention overcomes the beading problem is by applying a primer coat to at least the portion of the ball surface upon which the indicia is to be printed, the primer coat containing a material which promotes absorption, adhesion, and/or clarity of the indicia. Suitable materials of this type to use in the primer coat of a golf ball include talc, amorphous silica, bentonite clay, magnesium silicate, or the like, or a combination of these.

In another form of the invention, the material which promotes absorption, adhesion, and/or clarity of the indicia is incorporated into the cover itself. When the cover is formed from ionomer, polyurethane or balata, for example, suitable materials of this type which can be incorporated therein include talc, amorphous silica, bentonite clay, magnesium silicate, or the like, or a combination of these.

The ink which is used in the method of the invention is one which is suitable for use in an ink jet printer. Typically, the ink contains a coloring agent, a carrier, and additives. The coloring agent usually is a dye and/or pigment and can be fluorescent. Alternately, the ink can contain a fluorescent material as the coloring agent instead of or in addition to an ordinary dye. As another alternative, the ink can contain a selective absorber of infrared or microwave radiation. The carrier or vehicle for the coloring agent may be water or an organic solvent. The physical characteristics of the substrate and the other ink components determine the type and quantity of carrier to be used. Examples of useful additives include materials to control pH, viscosity, light fade and surface tension. Furthermore, the ink can contain a polymer resin or resin components. Examples of polymer resins or resin components which are used in conventional ink jet printing inks include polyurethanes, polyesters, polyketones and polyacrylates. In the case of a UV curable ink, the resin components could be, for example, oligomers. The ink composition and the composition of the ball cover or primer layer to which the indicia is to be applied may be selected such that the surface tension of the ink is appropriately related to the surface properties of the substrate to which it is to be adhered. Inks contemplated to be suitable for ink jet printing typically have a viscosity of from about 1 to about 20 cps measured at the temperature of application.

As indicated above, UV curable inks can be used in accordance with the method of the present invention. Most commercially available UV inks are not suitable for ink jet printing due to the high concentration and size of the pigments and fillers in these formulations. To facilitate flow through the ink jet printer, a UV ink suitable for an ink jet printer should incorporate very finely divided pigments (about 0.1 micron or alternatively less than 100 Angstroms), dissolved dyes, or combinations of dyes and finely divided pigments. Flow additives, surface tension modifiers, extra solvent, etc. may be added to the ink formula to improve ink jet printability and prevent clogging of the ink jet printer. UV curable inks are described below in further detail in a separate section of this document.

If a primer coating layer is applied to a golf ball cover, the coating typically is a solvent-borne or water-borne polyurethane material. Non-limiting examples of suitable coatings are described in detail in commonly assigned U.S. Pat. Nos. 5,409,233; 5,459,220 and 5,494,291, the contents of which are incorporated herein by reference.

It is useful for a top coat to be applied over the indicia to protect the indicia unless the indicia has sufficient adhesion to the surface to which it is applied, e.g., the cover or a primer layer, to render the use of a top coat unnecessary. The adhesion between the ink and the top coat and/or substrate is contemplated to be sufficiently strong so that the indicia remains substantially intact when the golf ball is used. Standards for image retention vary depending upon the intended use of the golf ball and the degree and frequency of impact that the image is required to withstand. When applied to a golf ball, the ink durability desirably is sufficient that after the ball is subjected to the wet barrel durability test procedure described below, at least about 50% of the surface area of the original image remains, optionally at least about 70%, optionally at least about 80%. Excellent durability results when more than about 85% of the image remains.

As indicated above, in one embodiment of the invention, the indicia is printed onto a transfer medium using an ink jet printer and are subsequently transferred to the golf ball surface. A suitable transfer medium is one which has a surface that allows for good clarity of the indicia printed thereon while providing for transfer of the image onto the golf ball surface. One contemplated transfer medium is a silicone pad. If necessary, an absorptive filler can be added to the silicone pad to promote flow-out of the ink, and to prevent beading on the surface of the silicone pad. Additionally or alternatively, the surface of the pad can be roughened to an extent necessary to achieve the desired surface energy. When the image is to be printed on a curved and dimpled surface of a golf ball, using a pad rather than a flat sheet for the transfer substrate may facilitate the application of ink inside the dimples. One contemplated type of silicone pad is that which is used in conventional golf ball pad printing.

Although any ink jet printer may be used, two types of ink jet printers specifically contemplated for printing on golf balls are continuous ink jet printers and drop on demand ink jet printers. In a continuous ink jet printer, a stream of ink drops is electrically charged and then deflected by an electronic field either directly or indirectly onto the substrate. In a drop on demand ink jet printer, the ink supply is regulated by an actuator such as a piezoelectric actuator. The pressure produced by the actuation forces a droplet through a nozzle or nozzles onto the substrate.

UV Curable Inks

The UV curable ink of the present invention can be used for printing indicia on golf balls, softballs, baseballs, other game balls, as well as other sporting good including, but not limited to, softball and baseball bats, tennis and racquetball rackets, and golf clubs. The ink also can be applied to a variety of materials including, but not limited to, ionomers, polybutadiene, composite materials, metals, etc.

As indicated above, the ink comprises a UV curable resin, a coloring agent, such as a pigment or a dye, one or more photoinitiators, and possibly a solvent. The ink may also include aluminum trihydroxide. A thinning agent that includes a monomer and/or a solvent can be added. A wetting agent also can be included.

The UV curable resin may comprise an oligomer. Non-limiting examples of the oligomer include one or more epoxies, acrylics, acrylate urethanes, elastomeric acrylates, unsaturated polyesters, and polyethers. Specific examples of suitable oligomers include methacrylates such as bisphenol A ethyoxylate dimethyacrylate and acrylated epoxies. Blends of different oligomers can be used. The oligomer can provide the ink with characteristics of flexibility and impact resistance that are sufficient to withstand the conditions to which the substrate is to be subjected. For example, if the substrate is a golf ball, the oligomer may impart to the ink more flexibility than is inherent in the underlying substrate, which is contemplated to provide good durability. When a top coat is to be placed over the ink, the ink desirably is not so highly cross-linked that adhesion of the top coat to the ink is substantially hindered.

The uncured ink can comprise about 10–90 wt % oligomer, optionally about 20–80 wt % oligomer, optionally about 50–70 wt % oligomer.

The coloring agent can be any type of pigment, dye or the like which will withstand UV treatment, i.e., which is not UV labile. Furthermore, the coloring agent is contemplated to permit sufficient passage of UV light through the ink, by any combination of transmission, reflection, or refraction mechanisms, to initiate photocrosslinking. Liquids or powders can be used. One non-limiting example of an ink is a powder which is dispersed in a liquid monomer. Carbon black and iron oxide black are non-limiting examples of suitable pigments for making black inks. Red lake and quinacrydones are non-limiting examples of suitable pigments for making red inks. Blends of different pigments and/or dyes can be used. The uncured ink can contain about 2–60 wt % colorant, alternatively about 5–30 wt % colorant, alternatively about 5–10 wt % colorant.

The photoinitiator is selected to respond to the wavelength of UV radiation to be used for photoinitiation. It is also important to consider the color of the ink in selecting the photoinitiator because, as indicated above, it is necessary to the UV light to penetrate the ink composition to initiate the cure. More specifically, penetration is sometimes required in order to cure the portion of the ink which is beneath the surface. Penetration typically is most difficult when black or white pigments are used. Non-limiting examples of photoinitiators to be used in conjunction with black pigment include sulfur-type photoinitiators such as isopropyl thioxanthone, and benzophenone and its derivatives including acetophenone types and thioxanthones. Photoactivators can be used in conjunction with one or more photoinitiators. Non-limiting examples of suitable photoactivators are amine-type photoactivators such as ethyl 4-dimethylamino benzoate. The uncured ink may contain about 0.3–5 wt % photoinitiator, alternatively about 1–4 wt % photoinitiator, alternatively about 3–4 wt % photoinitiator. Blends of different photoinitiators, or photoinitiators and photoactivators can be used.

A thinning agent can be added to lower the viscosity of the uncured ink composition or to contribute to impact resistance or flexibility. When a monomer is used as a thinning agent, it optionally can be a photopolymerizable monomer that forms a polymeric structure upon irradiation. In contrast, when solvents are used as thinning agents, they evaporate during curing. The monomer can be a monofunctional, difunctional or multifunctional acrylate. Non-limiting examples of suitable monomers include 1,6 hexanediol diacrylate, butanediol diacrylate, trimethylol propane diacrylate, tripropylene glycol diacrylate and tetraethylene glycol diacrylate.

The uncured ink may contain about 10–70 wt % monomer, alternatively about 10–60 wt % monomer, alternatively about 10–55 wt % monomer. The combination of monomer plus oligomer may constitute about 45–80 wt % of the uncured ink, optionally about 50–80%, optionally about 60–80 wt % of the ink.

Non UV curable quick-drying resins which help in ink transfer from the pad to the ball can be added. Non-limiting examples of such resins are vinyl resins, nitrocellulose, acrylic resins, and other quick-drying, film-forming resins. One contemplated resin is an acrylic-OH functional resin made by McWorther, Inc. of Carpentersville, Ill., sold as Resin 975. Typically, if such resins are used, they are added in an amount up to about 30 parts by weight based upon 100 total parts by weight of uncured ink composition.

When a solvent is used in the UV curable ink, it typically is a liquid with a fast to moderate evaporation rate which, upon partial evaporation causes the ink to be tacky, and thereby promotes transfer onto and off an ink pad. A solvent also can be the medium in which a photoinitiator is dissolved. Non-limiting examples of suitable solvents include aromatic solvents such as toluene, xylene, and ester types such as butyl acetate. The uncured ink may include about 1–30 wt % solvent, optionally about 5–20 wt % solvent, optionally about 8–10 wt % solvent.

Wetting agents can be added to prevent beading of the ink upon application to the golf ball. Suitable wetting agents include, but are not limited to, silicone surfactants and fluorocarbon surfactants. The uncured ink may include about 0–2 wt % wetting agent. Other additives that do not adversely affect the pad transfer and impact resistance of the ink also can be incorporated into the ink composition.

As long as sufficient durability is maintained, extender pigments such as talc; barium sulfate and the like can be added to improve transferability. For use in ink jet printers, the particle size of the extender pigments should be small enough to facilitate passage through the orifices of the printer. This would include finely divided (about less than 0.1 micron or alternatively less than 100 Angstroms) silicas, clays, or talcs, or combinations of these. Typically, if such materials are used, they constitute about 10–40 wt %, alternatively 20–30 wt %, of the uncured ink formulation.

It has been found that by replacing part or all of the extender pigments such as talc and barium sulfate with aluminum trihydroxide ($Al(OH)_3.3H_2O$) (ATH) filler, a number of significant improvements to the UV ink will result with respect to printing, curing and processing. Additionally, the inclusion of ATH will have minimal effect on the color of the ink. Furthermore, ATH has low oil absorption, thus ink viscosity is increased very little. When up to 50 wt % ATH based upon the total (uncured) weight of ink is added, ink transfer from a pad to a substrate is improved. Significantly, ATH does not absorb UV light so curing of the ink is not impeded. For use in ink jet printing, ATH particle size should be small enough to facilitate passage through ink jet orifices.

When ATH is used in a UV curable golf ball ink, it generally is included in an amount of 10–50 wt % based upon the total weight of the ink prior to curing. ATH may be employed in an amount of 10–32 wt %, alternatively 20–30 wt %. It is believed that ATH loadings up to at least 50 wt % based upon the weight of (uncured) ink may be useful for providing an overall balance of properties. Greater quantities of ATH can be used when a low cost ink is desired and durability requirements are not stringent. Lower quantities of ATH are useful when higher durability is needed. The ATH can be used in a quantity appropriate to impart to the ink a balance of properties such as pad transfer and durability of the ink.

If ATH is used in combination with talc, barium sulfite, or the like, the ratio of ATH to talc, etc., may be about 1:1.

The use of ATH does not impede the curing process. The surface tension of the ink affects the wetability of the substrate. The surface tension of the ink desirably is not substantially higher than the surface tension of the substrate upon which it is printed. The viscosity of the ink is one factor that will affect the thickness of the indicia on the cover. If the indicia is too thick, the UV radiation may not penetrate the indicia and complete curing may become difficult. On the other hand, if the indicia is too thin, the durability of the ink layer may be insufficient for conditions of play. The indicia has a thickness of less than about 100 microns, optionally about 10–40 microns, optionally about 13–30 microns, optionally about 20–25 microns.

The cured ink is contemplated to be sufficiently flexible to exhibit good impact resistance. It is advantageous for the top coat which is applied over the ink to react with the ink to hold the ink in place, or to have adhesion by hydrogen bonding and/or van der Waals forces. As a non-limiting example, the ink can be used in conjunction with a two-component polyurethane top coat, such as a top coat based on polyester or acrylic polyols and aliphatic isocyanates such as hexamethylene diisocyanate or isophorone diisocyanate trimers.

As one non-limiting example, a UV curable ink formulation of the invention which is used for marking golf balls can be prepared and used in the following way. The photoinitiator is dissolved in the thinning agent, which is then mixed with an oligomer, and a pigment. The mixture is placed in a dispenser for use in direct or indirect ink jet printing. A primed but unfinished golf ball is obtained. The ball includes, for example, a core, and a durable cover having a dimpled surface. Alternatively, the core and cover can be formed in one piece. An indicia formed from the UV curable ink is ink jet printed on to the golf ball cover either directly or indirectly by use of a transfer medium. The unfinished golf ball is then subjected to UV treatment under conditions sufficient to at least commence curing of the ink. After photoinitiation, curing of the ink is substantially complete within a time period of between less than one second and a few seconds.

A top coat layer is placed over the indicia. The top coat is optionally applied at least partially, and optionally completely, after the ink is cured. The top coat layer assists in keeping the indicia on the golf ball surface, as indicated above, and therefore the adhesion of an indicia to the golf ball does not need to be a strong as will be required if the ink constitutes the outer layer of the ball. The top coat typically has a thickness of 10–40 microns.

The conditions of UV exposure which are appropriate to cure the ink can be ascertained by one having ordinary skill in the art. For example, it has been found that when a golf ball passes through a UV treatment apparatus at a rate of about 10 ft./min. (about 3 m/min.) at a distance of about 1¼–1¾ inches (about 3.2–4.4 cm) from a UV light source which has an intensity of e.g. 200–300 watts/in$^2$ (31–47 watts/cm$^2$), the indicia may be exposed to UV radiation for no more than a few seconds, optionally no more than about 1 second, optionally no more than about 0.7 seconds. Higher and lower UV lamp intensities, distances, and exposure times may be used as long as the cured ink meets the applicable durability requirements. Excess UV exposure is avoided to prevent degradation of the substrate. The ink can be UV cured prior to application of any top coat.

The pad to be used for transfer of the UV ink according to one embodiment of the invention can contain silicone. This type of pad has good elasticity, durability and softness and an appropriate surface tension. Other types of pads also can be used.

The ink can be applied on a non-UV-labile surface of a golf ball. According to the invention, it is generally not necessary to pretreat the surface prior to application of the ink. If it is desired to apply the UV curable ink on an extremely smooth surface upon which transfer is poor, the portion of the surface to be stamped can be chemically or physically etched or abraded in order to provide an ink-receptive surface.

The ink of the invention has a Sward hardness (ASTM-D 2134-66) after curing of about no more than 55, alternatively about no more than 40, alternatively about no more than about 20.

The UV curable ink of the invention provides for durability sufficient to meet stringent durability standards required for commercial grade golf balls. The durability of the ink can be determined by testing stamped golf balls in a variety of ways, including using the wet barrel durability test procedure.

Figure 5:
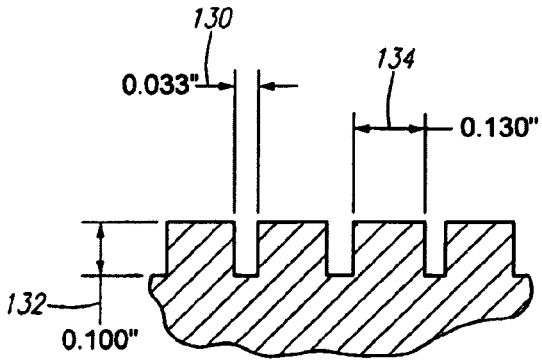
FIG. 5 is a partial side view of a portion of an insert plate in the durability test apparatus which has grooves intended to simulate a golf club face.
Figure 6A:
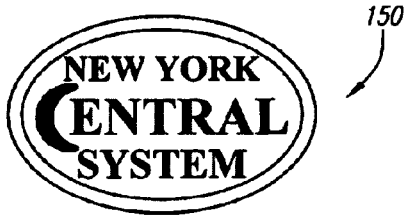
FIGS. 6-A through 6-D depict differences in pad transfer of four UV curable inks.
Figure 6B:
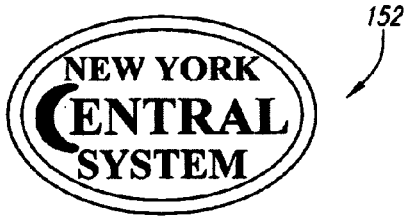
Figure 6C:
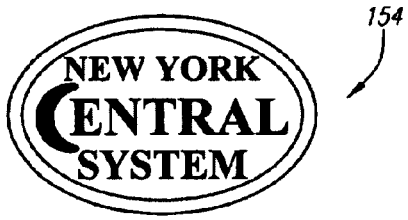
Figure 6D:
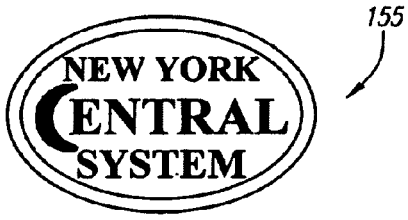

Durability according to the wet barrel durability test procedure is determined by firing a golf ball at 135 ft/sec (at 72° F.) (41 m/s (at 22° C.)) into 5-sided steel pentagonal container, the walls of which are steel plates. The container 110, which is shown schematically in FIG. 4, has a 19½ inch (49.5 cm) long insert plate 112 mounted therein, the central portion 114 of which has horizontally extending square grooves on it which are intended to simulate a square grooved face of a golf club. The grooves, which are shown in an exaggerated form in FIG. 5, have a width 130 of 0.033 inches (0.084 cm), a depth 132 of 0.100 inches (0.25 cm), and are spaced apart from one another by land areas 134 having a width of 0.130 inches (0.330 cm). The five walls 116 of the pentagonal container reach have a length of 14½ inches (36.8 cm). As shown in FIG. 4, the inlet wall is vertical and the insert plate is mounted such that it inclines upward 30° relative to a horizontal plane away from opening 120 in container 110. The ball travels 15½–15¾ inches (39.4–40 cm) horizontally from its point of entry into the container 110 until it hits the square-grooved central portion 114 of insert plate 112. The angle between the line of trajectory of the ball and the insert plate 112 is 30°. The balls are subjected to 70 or more blows (firings) and are inspected at regular intervals for breakage i.e., any signs of cover cracking or delamination). If a microcrack forms in a ball, it speed will change and the operator is alerted. The operator then visually inspects the ball. If the microcrack cannot yet be observed, the ball is returned to the test until a crack can be visually detected. The balls are then examined for adhesion of the ink.

The following examples are included to further describe the invention.

EXAMPLE 1

A golf ball printing ink was prepared which contains:

5 parts by weight 1,6 hexanediol diacrylate (sold by Sartomer, Exton, Pa.), 17.5 parts by weight black pigment paste in diacrylate monomer, sold as Carbon Black UV Dispersion 99B415 (Penn Color, Doylestown, Pa.), 35 parts by weight of an aliphatic urethane acrylate oligomer (CN965, sold by Sartomer, Exton, Pa.), 0.5 parts by weight isopropyl thioxanthone, $C_{16}H_{14}OS$, a sulfur-type photoinitiator (ITX, distributed by Aceto Chemical, Lake Success, N.Y.), 1 part by weight ethyl 4-dimethylamino benzoate, $C_{11}H_{15}NO_2$, an amine-type photoactivator (EDB, distributed by Aceto Chemical, Lake Success, N.Y.), 4.4 parts by weight xylene solvent, and 4.4 parts by weight butyl acetate solvent.

The photoinitiator and photoactivator were dissolved in the xylene/butyl acetate solvent blend. The ink was pad printed using a silicone pad or unprimed, dimpled ionomeric covers of several dozen golf balls. The ink had a viscosity of about 27,500 centipoise ("cps") at the time of application.

The balls containing the stamped indicia were passed through a Uvex UV treatment apparatus Lab Model #14201 at a rate of 10 feet/min. (3 m/min.), using a lamp intensity of 235 watts/in$^2$ (36.4 watts/cm$^2$) and wavelength range of 200–400 nm with the indicia being located about 1¾ inches (4.4 cm) from the UV light source. The ink was cured in less than about 1 second and had a Sward hardness of about 14 after curing was complete.

The golf balls were then coated with a solvent-borne polyurethane top coat formed from a polyester type hexamethylene diisocyanate. The adhesion of the indicia on the balls was tested for durability according to the wet barrel durability test procedure described above. After wet barrel durability testing, the balls were examined and it was found that no more than about 20% of the surface area of the original ink logo was removed.

EXAMPLE 2

The procedure of Example 1 was repeated with excepting that the ink formulation that was used contained:

10 parts by weight 1,6 hexanediol diacrylate (sold by Sartomer), 35 parts by weight black pigment paste in diacrylate monomer, sold as Carbon Black UV Dispersion 99B415, 70 parts by weight of a difunctional aliphatic urethane acrylate oligomer (Ebecryl 4833 sold by UCB, RadCure, Inc., Smyrna, Ga.), 1 part by weight isopropyl thioxanthone, $C_{16}H_{14}OS$ (ITX), and 2 parts by weight ethyl 4-dimethylamino benzoate (EDB).

The ink had a viscosity of about 25,000 cps. The ink was cured in about 1 second and produced a film having a Sward hardness of about 12. The balls were subjected to the wet barrel durability test procedure. After the wet barrel durability testing, it was found that no more than about 20% of the ink logo was removed.

EXAMPLE 3

The procedure of Example 1 was repeated excepting that the CN965 oligomer was replaced by a difunctional oligomer sold as Ebecryl 8402 (UCB RadCure, Inc., Smyrna, Ga.). The ink had a viscosity of about 18,000 cps. The ink was cured in about 1 second and produced a film having a Sward hardness of about 14. The ink was found to be as nearly as durable as that of Examples 1 and 2.

EXAMPLE 4

The procedure of Example 1 was repeated excepting that the ink formulation that was used contained:

7.3 parts by weight 1,6 hexanediol diacrylate (sold by Sartomer, Exton, Pa.), 19.2 parts by weight black pigment paste in diacrylate monomer, sold as ICU 386 (Industrial Color Inc., Joliet, Ill.), 21.0 parts by weight aliphatic polyether urethane oligomer (BR-571, Bomar Specialties Company, Winsted, Conn.), 0.5 parts by weight isopropyl thioxanthone, $C_{16}H_{14}OS$, a sulfur-type photoinitiator (ITX, distributed by Aceto Chemical, Lake Success, N.Y.), 1 part by weight ethyl 4-dimethylamino benzoate (EDB), 11.4 parts by weight talc (Vantalc 6H, Vanderbilt, Norwalk, Conn.), 22.9 parts by weight barium sulfate (106 Low-Micron White Barytles, Whittaker, Clark & Daniels, Inc., South Plainfield, N.J.), 12.1 parts by weight butyl acetate solvent, and 4.6 parts by weight propylene glycol monomethyl ether acetate solvent.

The ink was applied directly to ionomeric covers of golf balls, and also over ionomeric covers to which a water-borne polyurethane primer layer had been applied prior to application of the ink. The ink was cured in about 1 second and produced a film having a Sward hardness of about 14. The balls were top coated and subjected to the wet barrel durability test procedure. After the wet barrel durability testing, it was found that no more than about 20% of the ink logo was removed.

COMPARATIVE EXAMPLE 1

The procedure of Example 1 was repeated with the exception that a commercially available UV curable ink was used, namely Blk #700801 (Trans Tech, Carol Stream, Ill.). The ink had a viscosity of about 6,000 cps. The ink was cured in about 1 second and produced a film having a Sward hardness of about 26. After the wet barrel durability test only the outline of the logo remained. Most of the ink in the dimples and on the land areas had been removed. Intercoat adhesion between the ink and top coat was poor.

COMPARATIVE EXAMPLE 2

The procedure of Example 1 was repeated on several golf balls with the exception that a commercially available UV curable ink was used, namely L-526-163-B (Qure Tech, Seabrook, N.H.). The ink had a viscosity of about 28,500 cps. The ink was cured in about 1 second and produced a film having a Sward hardness of about 20. As a result of the wet barrel durability test, the ink on at least about 60% of the surface area of the logo had been removed. It is believed that the ink was too brittle to withstand the conditions of the wet barrel durability test.

EXAMPLE 5

ATH-containing formulation 1, shown below, was prepared:

| ATH-Containing Formulation 1 | Parts by Weight |
|---|---|
| Acrylic-OH functional resin[1] | 540.5 |
| Acetate and aromatic hydrocarbon solvent blend[2] | 189.2 |
| ATH[3] | 270.3 |
| | 1000.0 |

[1]McWorther Resin 975 (McWorther, Inc., Carpentersville, IL).
[2]Summit Ink Reducer, Summit PT #910527 (Summit Screen Inks, No. Kansas City, MO) Alternatively, a mixture based upon 43.4 parts by weight butyl acetate, 28.3 parts by weight xylene and 28.3 parts by weight propylene glycol monomethyl ether acetate can be used.
[3]ATH SpaceRite S-3 (ALCOA Industries, Bauxite, AR).

The ATH-containing formulation 1 was then used to form a golf ball ink which contained:

5 parts by weight aliphatic urethane triacrylate (BR-990, Bomar Specialties Co., Winsted, Conn.), 35 parts by weight ATH-containing formulation 1, 5.5 parts by weight trimethylolpropane triacrylate (TMPTA) (Sartomer Co., West Chester, Pa.), 5 parts by weight black dispersion in oligomer/monomers (ICU 386, Industrial Color Inc., Joliet, Ill.), 0.3 parts by weight isopropyl thioxanthone, $C_{16}H_{14}OS$, a sulfur-type photoinitiator (ITX, distributed by Aceto Chemical, Lake Success, N.Y.), 1 part by weight ethyl 4-dimethylamino benzoate, $C_{11}H_{15}NO_2$, an amine-type photoactivator (EDB, distributed by Aceto Chemical, Lake Success, N.Y.), and 10 parts by weight ATH (SpaceRite S-3, ALCOA Industries, Bauxite, Ark.).

All ingredients were mixed and dispersed on high speed mixing equipment. The ink was pad printed using a silicone pad on unprimed, dimpled ionomeric covers of several dozen golf balls.

The balls containing the stamped indicia were passed through a Uvex UV lamp at a rate of 10 feet/min. (3 m/min.), using a lamp intensity of 235 watts/in.$^2$ (36.4 watts/cm$^2$) and a wavelength range of 200–400 nm with the indicia being located about 1¾ inches (4.4 cm) from the UV light source. The ink was cured in less than one second.

The golf balls were then coated with a two component polyester/aliphatic polyisocyanate clear coat.

The printability, jetness, detail image, pad release, and durability of the ink was evaluated and was compared with three sets of control inks, designated as Control A, Control B, and Control C. The formulations of the Control A and Control B inks are shown below:

Control A

| | parts by wt. |
|---|---|
| Aliphatic urethane-acrylic oligomer[1] | 6.45 |
| Acrylic-OH functional resin[2] | 42.96 |
| Acetate and aromatic hydrocarbon solvent blend[3] | 8.85 |
| Talc[4] | 5.59 |
| Barium sulfate[5] | 12.89 |
| Black dispersion in oligomer/monomer[6] | 6.01 |
| TMPTA[7] | 15.18 |
| Isopropyl thioxanthone[8] | 0.69 |
| Ethyl 4-dimethylamino benzoate[9] | 1.38 |
| | 100.00 |

[1]BR-571 (Bomar Specialties Co., Winsted, CT).
[2]McWorther Resin 975 (McWorther, Inc., Carpentersville, IL).
[3]Summit Ink Reducer (PT #910527 Summit Screen Inks, No. Kansas City, MO).
[4]Van Talc #6H (Vanderbilt, Norwalk, CT).
[5]Barytes #22 (Whittaker, Clark & Daniels, Inc., South Plainfield, NJ).
[6]ICU 386 (Industrial Color Inc., Joliet, IL).
[7](Sartomer Co., West Chester, PA).
[8]ITX (distributed by Aceto Chemical, Lake Success, NY).
[9]EDB (distributed by Aceto Chemical, Lake Success, NY).

Control B

| | parts by wt. |
|---|---|
| Epoxy-acrylate oligomer[1] | 19.24 |
| Acrylic-OH functional resin[2] | 27.70 |
| Acetate and aromatic hydrocarbon solvent blend[3] | 13.84 |
| Talc[4] | 7.69 |
| Barium sulfate[5] | 7.69 |
| Black dispersion in oligomer/monomer[6] | 6.15 |
| Polyester-acrylate oligomer[7] | 15.38 |
| Isopropyl thioxanthone[8] | 0.77 |
| Ethyl 4-dimethylamino benzoate[9] | 1.54 |
| | 100.00 |

[1]Ebecryl 3700 (Rad-Cure, Smyrna, GA).
[2]McWorther Resin 975 (McWorther, Inc., Carpentersville, IL).
[3]Summit Ink Reducer (PT #910527 Summit Screen Inks, No. Kansas City, MO).
[4]Van Talc 6H (Vanderbilt, Norwalk, CT).
[5]Barytes #22 (Whittaker, Clark & Daniels, Inc., South Plainfield, NJ).
[6]ICU 386 (Industrial Color Inc., Joliet, IL).
[7]Ebecryl 80 (Rad-Cure, Smyrna, GA).
[8]ITX (distributed by Aceto Chemical, Lake Success, NY).
[9]EDB (distributed by Aceto Chemical, Lake Success, NY).

Control C was Trans Tech ink # 2P37-2 (Trans Tech, Carol Stream, Ill.). The ratings for the various ink formulations are shown below:

| Ink | Printability | Jetness | Detail Image | Pad Release | Durability |
|---|---|---|---|---|---|
| Example 5 | 1½ | 1 | 1 | 1½ | 1 |
| Control A | 2½ | 2½ | 2 | 2½ | 1 |
| Control B | 3 | 2½–3 | 2½ | 3 | 2½ |
| Control C | 1½–2 | 1 | 1 | 1½–2 | 2½ |

Ratings were from 1–5 with 1 being ideal and 5 being unacceptable. All of the balls of Example 5 and the balls of Controls A, B and C were covered with a one-coat top coating system of 160 mg, the top coating being a two component polyester/aliphatic polyisocyanate clear coat.

The ink of Example 5 had a oligomer/monomer content of 22.608 wt %, an acrylic resin content of 21.508 wt %, a black pigment content of 3.08 wt %, an ATH pigment content of 31.63 wt %, a solvent content of 20.008 wt % and an initiator content of 1.62 wt %. The density of the ink was 10.68 lbs./gal. (1.28 kg/L), the total nonvolatiles content was 80%, and the volatile organic compounds constituted 2.14 lbs./gal. (0.256 kg/L). The viscosity of the ink was 11,000 cps at the time of application. After curing, the smudge resistance of the ink was tested using methyl ethyl ketone solvent. No smudging occurred.

It has been found that the solvent content of the ink can be significantly increased without reducing the quality of the identification stamp. For example, by further reducing the ink by 30% (by adding solvent), the viscosity of the ink should decrease to about 1420 cps. An ink with this low viscosity tends to have better printability than more viscous inks on certain pad printing machines.

FIG. 6 shows a silicone pad after 12 golf balls have been stamped with a particular type of ink. FIG. 6A (150) shows the stamp after stamping with the ink of Control A. FIG. 6B (152) shows the silicone pad after stamping with the ink of Control B. FIG. 6C (154) shows the pad after stamping with the ink of Example 5. FIG. 6D (155) shows the pad after stamping with Control C. As indicated by the resulting stamps, the best transfer, i.e. the least quantity of ink remaining on the stamp, resulted from the use of the ink of Example 5.

EXAMPLE 6

ATH-containing formulation 2, shown below, was prepared:

| ATH-Containing Formulation 2 | Parts by Weight |
|---|---|
| Acrylic-OH functional resin[1] | 21.84 |
| Propylene glycol monomethyl ether acetate solvent[2] | 4.85 |
| ATH[3] | 20.70 |
| Talc[4] | 19.50 |
| Black dispersion in oligomer/monomer[5] | 9.50 |
| | 76.39 |

[1]McWorther Resin 975, (McWorther, Inc., Carpentersville, IL).
[2]Dow Chemical (and others).
[3]ATH SpaceRite S-3 (ALCOA Industries, Bauxite, AR).
[4]Van Talc #6H (Vanderbilt, Norwalk, CT).
[5]ICU 386 (Industrial Color Inc., Joliet, IL).

After the formulation was mixed, the following materials were added:

1.31 parts by weight butyl acetate, (Eastman Chemical and others), 6.16 parts by weight Aromatic 100 or HiSol 53, (Ashland Chemicals), 3.08 parts by weight cyclohexanone (Ashland Chemicals), 0.50 parts by weight isopropyl thioxanthone, $C_{16}H_{14}OS$, a sulfur-type photoinitiator (ITX, distributed by Aceto Chemical, Lake Success, N.Y.), 1 part by weight ethyl 4-dimethylamino benzoate, $C_{11}H_{15}NO_2$, an amine-type photoactivator (EDB, distributed by Aceto Chemical, Lake Success, N.Y.), 5.78 parts by weight aliphatic urethane triacrylate (UV curable resin) (BR-990, Bomar Specialties Co., Winsted, Conn.), and 5.78 parts by weight trimethylolpropane triacrylate (UV curable resin) (TMPTA) (Sartomer Co., West Chester, Pa.).

The total parts by weight were 100. All ingredients were mixed and dispersed using high speed mixing equipment.

The ink was pad printed using a silicone pad on unprimed, dimpled ionomeric covers of a large number of golf balls. The golf balls containing stamped indicia were passed through a Uvex UV lamp at a rate of 10 ft/min (3 m/min.), using a lamp intensity of 235 watts/in.$^2$) and a wavelength range of 200–400 nm with the indicia being located at about 1¾ inches (4.4 cm) from the UV light source. The ink was cured in less than one second.

The golf balls were then coated with a two-component polyester/aliphatic polyisocyanate clear coat and were subjected to the wet barrel durability test procedure. After the wet barrel durability testing, it was found that no more than about 20% of the ink logo was removed.

EXAMPLE 7

The procedure of Example 6 was repeated with the exception that the quantity of ATH was reduced to 19.20 parts by weight, and the ATH-containing formulation (ATH-containing formulation 2) included only 0.22 parts by weight of black dispersion in oligomer/monomer (CU 386, Industrial Color Inc., Joliet, Ill.), and further contained 8.16 parts of a first red dispersion in oligomer/monomer (ICU Red Lake C, Industrial Color Inc., Joliet, Ill.) and 2.62 parts of a second red dispersion in oligomer/monomer (ICU Lithol 388 red, Industrial Color Inc., Joliet, Ill.). All ingredients were mixed and dispersed on high speed mixing equipment. The total parts by weight were 100.

After the wet barrel durability testing, it was found that no more than about 20% of the ink logo was removed.

EXAMPLE 8

ATH-containing formulation 3, shown below, was prepared:

| ATH-Containing Formulation 3 | Parts by Weight |
|---|---|
| Acrylic-OH functional resin[1] | 30.78 |
| Butyl acetate solvent | 4.67 |
| Xylene solvent[2] | 3.04 |

-continued

| ATH-Containing Formulation 3 | Parts by Weight |
|---|---|
| Propylene glycol monomethyl ether acetate solvent | 3.04 |
| ATH[5] | 31.66 |
| | 73.19 |

[1]McWorther Resin 975 (McWorther, Inc., Carpentersville, IL).
[2]Shell
[3]ATH SpaceRite S-3 (ALCOA Industries, Bauxite, AR).

After mixing, the following materials were added:

5.69 parts by weight red dispersion in oligomer/monomer (ICU Red Lake C, Industrial Color Inc., Joliet, Ill.), 1.92 parts by weight red dispersion in oligomer/monomer (ICU Lithol Rubine, Industrial Color Inc., Joliet, Ill.), 0.47 parts by weight black dispersion in oligomer/monomer (ICU 386, Industrial Color Inc., Joliet, Ill.), 0.49 parts by weight isopropyl thioxanthone, $C_{16}H_{14}OS$, a sulfur-type photoinitiator (ITX, distributed by Aceto Chemical, Lake Success, N.Y.), 1.14 parts by weight ethyl 4-dimethylamino benzoate, $C_{11}H_{14}NO_2$, an amine-type photoactivator (EDB, distributed by Aceto Chemical, Lake Success, N.Y.).

8.14 parts by weight aliphatic urethane triacrylate (BR-990, Bomar Specialties Co., Winsted, Conn.), and 8.95 parts by weight trimethylolpropane triacrylate (TMPTA) (Sartomer Co., West Chester, Pa.).

The total parts by weight were 99.99.

To provide for optimum printing, the viscosity of the ink was reduced to 1200 cps by adding 15 wt % (based upon the weight of the ink before reduction) of a solvent which was made by mixing 43.4 parts by weight butyl acetate, 28.3 parts by weight xylene and 28.3 parts by weight propylene glycol monomethyl ether acetate.

The ink was printed on a number of golf balls. The golf balls were then coated with a two-component polyester/aliphatic polyisocyanate clear coat and were subjected to the wet barrel durability test procedure. After the wet barrel durability testing, it was found that no more than about 20% of the ink logo was removed. The balls which were initially printed had a crisp image. After time, some ghosting appeared.

EXAMPLE 9

ATH-containing formulation 4, shown below, was prepared:

| ATH-Containing Formulation 4 | Parts by Weight |
|---|---|
| Acrylic-OH functional resin[1] | 21.63 |
| Butyl Acetate | 7.57 |
| ATH[2] | 21.34 |
| Talc[3] | 19.35 |
| First red dispersion in oligomer/monomer[4] | 7.04 |
| Second red dispersion in oligomer/monomer[5] | 2.26 |
| Black dispersion in oligomer/monomer[6] | 0.61 |
| Xylene solvent | 3.80 |
| | 83.60 |

[1]McWorther Resin 975 (McWorther, Inc., Carpentersville, IL).
[2]ATH SpaceRite S-3 (ALCOA Industries, Bauxite, AR).
[3]Van Talc #6H (Vanderbilt, Norwalk, CT).
[4]ICU Red Lake C, (Industrial Color Inc., Joliet, IL).
[5]ICU Lithol Rubine 388, (Industrial Color Inc., Joliet, IL).
[6]ICU 386 (Industrial Color Inc., Joliet, IL).

After mixing, the following materials were added:

3.80 parts by weight propylene glycol monomethyl ether acetate solvent, 0.38 parts by weight isopropyl thioxanthone $C_{16}H_{14}OS$, a sulfur-type photoinitiator (ITX, distributed by Aceto Chemical, Lake Success, N.Y.), 0.86 parts by weight ethyl 4-dimethylamino benzoate, $C_{11}H_{14}NO_2$, an amine-type photoactivator (EDB, distributed by Aceto Chemical, Lake Success, N.Y.), 5.69 parts by weight aliphatic urethane triacrylate (BR-990, Bomar Specialties Co., Winsted, Conn.), and 5.69 parts by weight trimethylolpropane triacrylate (TMPTA) (Sartomer Co., West Chester, Pa.).

Total parts by weight were 100.02.

The ink was printed on a number of golf balls. The image was very dark. A satisfactory image probably could have been obtained using a lower level of black dispersion. The golf balls were then coated with a two-component polyester/aliphatic polyisocyanate clear coat and were subjected to the wet barrel durability test procedure. After the wet barrel durability testing, it was found that no more than about 20% of the ink logo was removed.

EXAMPLE 10

Figure 7:
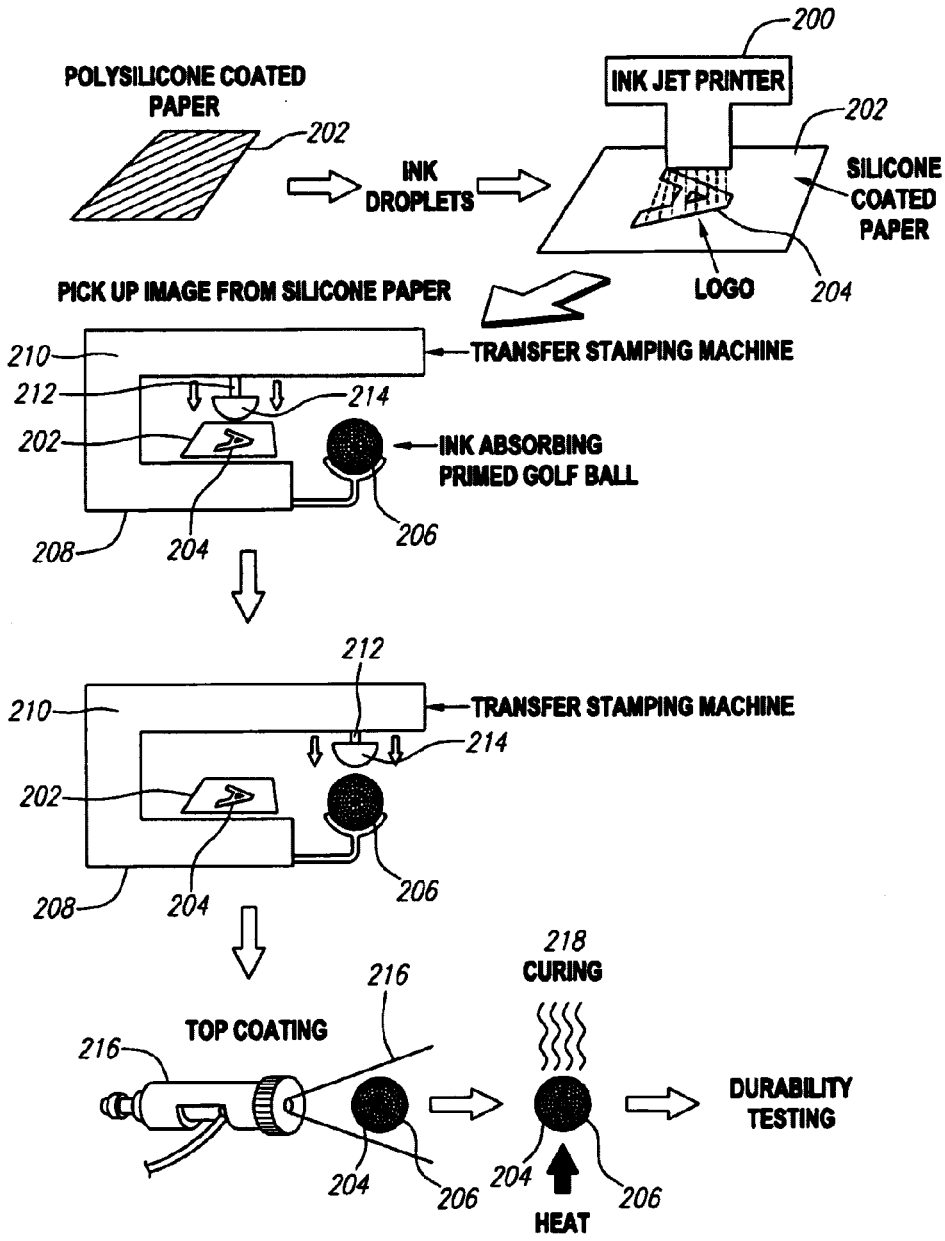
FIG. 7 depicts a method for applying an indicia to a golf all via a logo stamping machine using ink jet printed ink.

Referring to FIG. 7, an ink jet printer (Epson Stylus Color 640) 200 was used to print an image from a JPEG computer file onto a polysilicone coated sheet of paper (Dow Corning HS2) 202. This resulted in an ink jet logo 204 on the silicone coated paper 202.

An ionomer covered golf ball 206 was obtained which had been coated with an ink retaining primer coat formed from 100.00 parts by weight of Wicobond 235 (Witco), which is a water borne polyurethane primer, and 7.0 parts by weight of amorphous silica (Hi-Sil 915, PPG, Pittsburgh, Pa.). After the primer coating had dried, the image 204 on the silicone paper 202 was transferred to the surface of the golf ball 206 using a golf ball logo stamping machine 208.

More particularly, the ball logo stamping machine 208 has a horizontal arm 210 to which is attached a plunger 212 carrying a transfer pad 214. The silicone coated paper 202 holding the logo 204 was placed underneath the transfer pad 214. The plunger 212 advanced the transfer pad 214 against the logo 204, lifting the logo image 204 onto the transfer pad 214. The transfer pad 214 retracted, moving along the arm 210 to a second position beneath which a golf ball 206 was held. At this second position, the plunger 212 advanced the transfer pad 214 against the primed golf ball 206, stamping the newly imprinted image onto the ball 206.

After the ink was dry, the primed golf ball 206 with the stamped image was then coated with a top coat 216 of the following formulation

| | Parts by Weight |
|---|---|
| Polyol (Desmophen 670–80, Bayer Corp.) | 100.0 |
| Isocyanate (Desmodur N-3200, Bayer Corp.) | 30.0 |
| Methyl amyl ketone solvent | 50.0 |
| Butyl acetate solvent | 25.0 |
| Methyl isobutyl ketone solvent | 25.0 |
| UV absorber (Sandoz 3206) | 2.0 |
| UV stabilizer (Tinavin 292, CibaGeigy) | 1.0 |
| | 233.0 |

After the top coat was cured at an elevated temperature, as shown at 218, the ball was durability tested using the wet barrel test described above. About 80% of the ink logo remained. This process produced a multi-color logo with good distinction, recognition and durability on a dimpled and curved surface of a golf ball.

EXAMPLE 11

An ionomer covered golf ball was obtained which had been coated with an ink retaining primer coat formed from 100.00 parts by weight of Witcobond 235 (CK Witco, Stamford, Conn.), which is a water borne polyurethane primer, 10.0 parts of talc (magnesium silicate), 1.0 part by weight of amorphous silica (Hi-Sil 532EP, PPG, Pittsburgh, Pa.), and 5 parts by weight of polyaziridine (Zeneca Resus, Wilmington, Mass.). The primer coating was allowed to dry.

A solvent-based printing ink of the following formulation was prepared:

50.0 parts by weight isopropanol, 2.0 parts by weight ethylene glycol monbuyl ether, 15.0 parts by weight methyl isobutyl ketone (MIBK), 6.0 parts by weight Savinyl Dyes, solvent soluble metal complex dyes, sold by Clariant Corp., Coventry, R.I., and 3.0 drops BYK 346, a polyether modified polydimethyl siloxane, sold by BYK Chemie, Wallingford, Conn.

Figure 10:
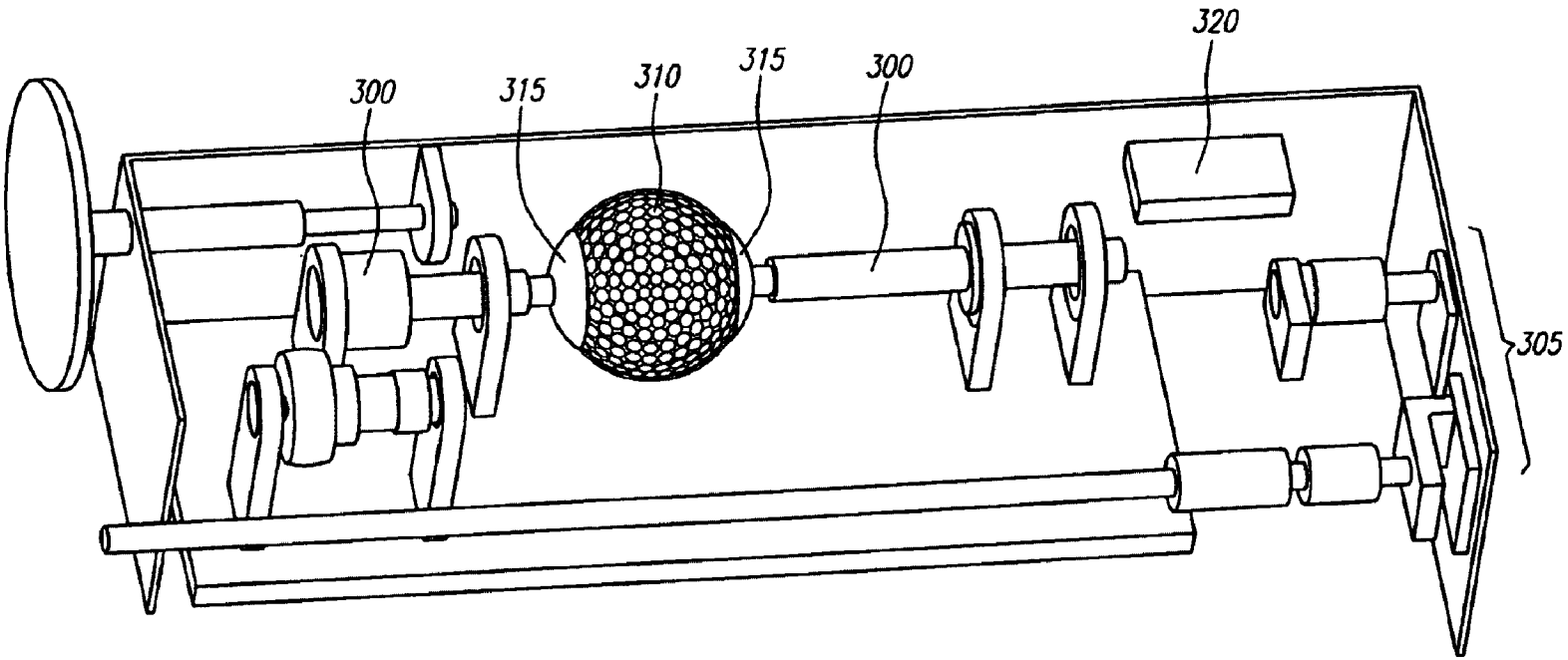
FIG. 10 depicts the adaptations made to the drive system of an ink jet printer to allow for accommodation of a golf ball.

The above ink formulation was ink jet printed directly onto the primed golf ball using an Epson Stylus Color 640 ink jet printer, a drop on demand piezoelectric printer. The drive system of the ink jet printer was physically adapted to allow for printing directly on to the golf ball as shown in FIG. 10. The adaptation was constructed in such a manner that the game ball had the identical indexing or rotational speed as paper that is driven through the printer. Referring to FIG. 10, a rotational system 305 consisting of a series of shafts connected by belts and pulleys rotated the main drive shaft 300. A game ball 310 was held by two suction units 315 that rotated with the main drive shaft 300. The rotational system 305 advanced the main drive shaft 300 at such a rate that the game ball 310 advanced at a rate identical to the index speed of a piece of paper. The ink jet printhead 320 advanced horizontally across the game ball 310, printing the desired image onto the game ball 310 in a series of passes.

The ink had a viscosity of about 6 cps at the time of application.

The resulting golf ball had a clean, durable and opaque image found thereon.

After the ink was dry, the golf ball with the image thereon was then coated with a solvent-borne two-part aliphatic polyurethane top coat which is described in U.S. Pat. No. 5,459,220. The opacity, clarity and color of the image did not change upon application of the top coat.

Figure 9:
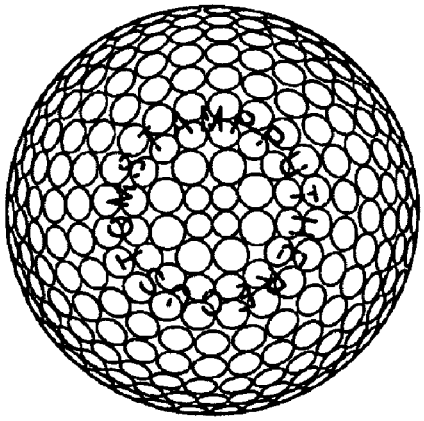
FIG. 9 depicts a golf ball with an indicia imprinted by an ink jet printer using solvent-based (non-aqueous) ink after being subjected to the wet barrel durability test.

The ball was durability tested using the wet barrel test, breaking after 197 blows. The results after durability testing are shown in FIG. 9. After testing, the balls were examined and it was found that about 80% of the ink logo remained. This process produced a multi-color logo with good distinction, recognition and durability on a dimpled and curved surface of a golf ball.

Figure 8:
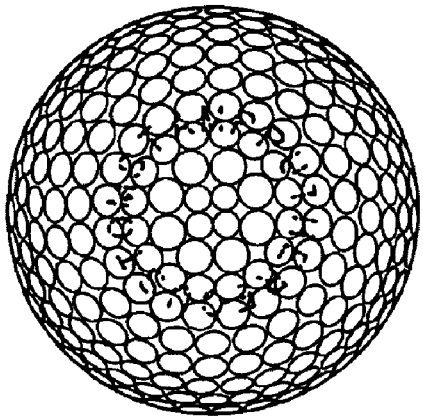
FIG. 8 depicts a golf ball with an indicia imprinted by custom stamping—by pad printing using a conventional solvent-borne pad printable ink—after being subjected to the wet barrel durability test.

This result can be compared to the results after durability testing a golf ball that was custom stamped by pad printing using a conventional solvent-borne pad printable ink. FIG. 8 depicts a golf ball that has been subjected to wet barrel testing after an indicia was imprinted via custom stamping. The ball broke after 186 blows. After wet barrel durability testing, far less of the ink logo remained on the custom stamped ball in FIG. 8 than the ink jet printed ball in FIG. 9.

EXAMPLE 12

The procedure of Example 11 was repeated with the exception that a water-based printing ink of the following formulation was substituted:

50.0 parts by weight water, 5.0 parts by weight isopropanol, 6.0 parts by weight Sandovac-L Dyes, sold by Clariant Corp, Coventry, R.I., and 3.0 drops BYK 346, a polyether modified polydimethyl siloxane, sold by BYK Chemie, Wallingford, Conn.

The resulting golf ball had a clear and durable image formed thereon. While the opacity of this image was slightly less than that of the image on the ball of Example 11, the opacity could be improved by using a larger quantity of dye or by increasing the mixing intensity of the formula during preparation in order to better disperse the dye.

COMPARATIVE EXAMPLE 3

The procedure of Example 11 was repeated excepting that a commercially available glycol-based ink formulation, found in conventional ink jet ink cartridges, namely Epson Ink Jet Printer ink formulation found in ink cartridges for use with the Epson Stylus Color 640 ink jet printer, was sued. The ink had a viscosity of about 5 or 6 cps. This process did not produce an acceptable image.

EXAMPLE 13

A golf ball printing ink was prepared which contained Formula C. To prepare Formula C, Formulas A and B were first prepared:

Formula A

| | Parts by Weight |
|---|---|
| Epoxy-acrylate oligomer[1] | 70.0 |
| Polyester-acrylate oligomer[2] | 30.0 |
| Butyl acetate | 100.0 |
| Methyl isobutyl ketone (MIBK) | 100.0 |
| Isopropyl thioxanthone[8] | 0.7 |
| Ethyl 4-dimethylamino benzoate[9] | 1.5 |
| | 302.2 |

[1]Ebecryl 3700 (Rad-Cure, Smyrna, GA).
[2]Ebecryl 80 (Rad-Cure, Smyrna, GA).
[8]ITX (distributed by Aceto Chemical, Lake Success, NY).
[9]EDB (distributed by Aceto Chemical, Lake Success, NY).

Formula B

| | Parts by Weight |
|---|---|
| Formula A | 40.0 |
| Savinyl Daye* | 1.0 |
| | 41.0 |

*E.g., One of the following: Savinyl Blue GLS, Savinyl Yello RLS, Savinyl Black RLSN, or Savinyl Pink 6BLS (Clariant Corp., Coventry, R.I.).

Formula C

| | Parts by Weight |
|---|---|
| Formula A | 20.0 |
| Formula B | 20.0 |
| MIBK | 20.0 |
| | 50.0 |

The ingredients of Formula C were mixed and ink jet printed directly onto the golf ball primed with the primer of Example 11 and using the ink jet printer of Example 11. The drive system of the ink jet printer, a piezoelectric printer, was physically adapted to allow for printing directly on to the golf ball.

The balls containing the stamped indicia were passed through a Uvex UV treatment apparatus at a rate of about 10 feet/min. (3 m/min.), using a lamp intensity of about 235 watts/in$^2$ (36.4 watts/cm$^2$) and wavelength range of about 200–400 nm with the indicia being located about 1¾ inches (4.4 cm) from the UV light source.

The indicia on the ball was distinct and durable.

PROPHETIC EXAMPLE 14

A golf ball printing ink is prepared which contains:

| | Parts by Weight |
|---|---|
| Epoxy-acrylate oligomer[1] | 20.0 |
| Acylic-OH functional resin[2] | 30.0 |
| Acetate and aromatic hydrocarbon solvent blend[3] | 15.0 |
| Black Dye[4] | 15.0 |
| Polyester-acrylate oligomer[5] | 15.0 |
| Isopropyl thioxanthone[5] | 1.0 |
| Ethyl 4-dimethylamino benzoate[7] | 1.5 |

[1]Ebecryl 3700 (Rad-Cure, Smyrna, GA).
[M]cWorther Resin 975 (McWorther, Inc., Carpentersville, IL).
[3]Summit Ink Reducer (PT#910527, Summit Screen Inks, NO. Kansas City, MO).
[4]E.g., Savinyul Black RLS (Clariant Corp., Coventry, R.I.).
[5]IEbecryil 80 (Rad-Cure, Smyrna, GA).
[6]IITX (distributed by Aceto Chemical, Lake Success, NY).
[7]EDB (distributed by Aceto Chemical, Lake Success, NY).

The ingredients are mixed. The ink is sufficiently diluted with solvent, e.g., butoyl acetate, to constitute a viscosity of between about 1 to 20 cps, optionally between about 5 to 10 cps, optionally between about 5 to 6 cps.

The above ink formulation is ink jet printed directly onto the primed golf ball using the ink jet printer of Example 11. The drive system of the ink jet printer, a piezoelectric printer, is physically adapted to allow for printing directly on to the golf ball.

The balls containing the stamped indicia are passed through a Uvex UV treatment apparatus at a rate of about 10 feet/min. (3 m/min.), using a lamp intensity of about 235 watts/in$^2$ (36.4 watts/cm$^2$) and wavelength range of about 200–400 nm with the indicia being located about 1¾ inches (4.4 cm) from the UV light source.

The golf balls are then coated with a solvent-borne polyurethane top coat formed form a polyester type hexamethylene diisocyanate.

PROPHETIC EXAMPLE 15

The procedure of Example 12 is repeated excepting that a Hewlett Packard 693C bubble jet printer, a drop on demand printer, is substituted for the Epson Stylus Color 640 ink jet printer.

PROPHETIC EXAMPLE 16

The procedure of Example 12 is repeated excepting that 10 parts by weight of black pigment, Microlith Black C-WA (CIBA Specialty Chemicals Corp. USA, Newport, Del.), is substituted for the Sandovac-L Dyes. The pH of the composition is increased to at least 8.5 by adding an amine such as triethanol amine.

As will be apparent to persons skilled in the art, various modifications and adaptations of the structure above described will become readily apparent without departure from the spirit and scope of the invention, the scope of which is defined in the appended claims.

We claim:

1. A golf ball having an indicia on its dimpled surface, the golf ball produced by the method comprising:

providing an ink composition adapted for ink jet printing the ink composition comprising aluminum trihydroxide in an amount ranging from 10 to 50 weight percent of the total weight of the ink composition and an aliphatic urethane triacrylate;

applying the ink composition in the form of the indicia on a transfer medium using an ink jet printer; and transferring the indicia from the transfer medium to the dimpled surface of the golf ball, the indicia on the dimpled surface of the golf ball having a thickness of less than 100 microns.

2. The golf ball produced by the method according to claim 1, wherein the transfer medium comprises at least one member selected from the group consisting of silicone, fluoropolymer, polypropylene, and combinations thereof.

3. The golf ball produced by the method according to claim 1, wherein the transfer medium comprises a low surface energy material.

4. The golf ball produced by the method according to claim 1, wherein the transfer medium comprises silicone.

5. The golf ball produced by the method according to claim 1, wherein the transfer medium comprises a fluoropolymer.

6. The golf ball produced by the method according to claim 1, wherein the transfer medium comprises polypropylene.

7. The golf ball produced by the method according to claim 1, wherein the ink composition comprises a polymer resin.

8. The golf ball produced by the method according to claim 1, wherein the ink composition comprises resin components.

9. The golf ball produced by the method according to claim 1, further comprising:

forming a protective coating over the indicia on the dimpled surface of the golf ball.

10. The golf ball produced by the method according to claim 9, wherein the coating comprises a polyurethane.

11. The golf ball produced by the method according to claim 9, further comprising:

forming a primer coating layer on at least a portion of the dimpled surface of the golf ball prior to the applying step.

12. The golf ball produced by the method according to claim 11, wherein the primer coating layer includes a material which promotes at least one of absorption, adhesion and clarity of the indicia.

13. The golf ball produced by the method according to claim 12, wherein the material which promotes at least one of absorption, adhesion and clarity of the indicia includes at least one member selected from the group consisting of talc, amorphous silica, bentonite clay, and magnesium silicate.

14. The golf ball produced by the method according to claim 1, wherein the ink composition comprises a UV curable resin, further comprising:

curing the indicia after the indicia has been transferred onto the dimpled surface of the golf ball.

15. The golf ball produced by the method according to claim 1, wherein the transfer medium is a silicone-containing pad.

16. The golf ball produced by the method according to claim 1, wherein the transfer medium is a silicone-coated sheet.

17. The golf ball produced by the method according to claim 1, wherein the ink composition is an aqueous-based formulation.

18. The golf ball produced by the method according to claim 1, wherein the ink composition is a non-aqueous-based formulation.

* * * * *